US005957787A

United States Patent [19]

Hwang

[11] Patent Number: 5,957,787

[45] Date of Patent: Sep. 28, 1999

[54] GOLF BALL HAVING ANNULAR DIMPLES

[75] Inventor: In Hong Hwang, Seoul, Rep. of Korea

[73] Assignee: Woohak Leispia Inc., Rep. of Korea

[21] Appl. No.: 09/140,243

[22] Filed: Aug. 26, 1998

[30] Foreign Application Priority Data

Jul. 1, 1998 [KR] Rep. of Korea ..... 98-26369

[51] Int. Cl.[6] ..... A63B 37/14

[52] U.S. Cl. ..... 473/379; 473/384

[58] Field of Search ..... 473/379, 383, 473/384

[56] References Cited

U.S. PATENT DOCUMENTS

| | | | |
|---|---|---|---|
| 4,560,168 | 12/1985 | Aoyama | 473/379 |
| 4,915,390 | 4/1990 | Gobush et al. | 473/379 |
| 5,018,741 | 5/1991 | Strefel et al. | 473/379 |
| 5,575,477 | 11/1996 | Hwang | 473/379 |

*Primary Examiner*—George J. Marlo
*Attorney, Agent, or Firm*—Amster, Rothstein & Ebenstein

[57] ABSTRACT

A golf ball has a plurality of dimples in its spherical outer surface and its spherical outer surface is divided into the faces of an icosahedron consisting of 20 regular spherical triangles, and the golf ball's spherical outer surface is further divided by great circle paths which obtained by extending spherical straight lines connecting the midpoint of each side of the sperical triangles of icosahedron to its opposite apex, then large spherical pentagons will be created on the polar regions of the golf ball's spherical outer surface. The center of large pentagon as a pole, which is a common apex of 5 regular spherical triangles of the spherical icosahedron, from the pole, spherical straight lines extend along the both sides of each of the 5 spherical triangles to the equator. (Same thing happens on the opposite pole.) The spherical outer surface is further divided by the spherical straight lines into small sections to arrange the dimples. Regarding to the dimples, arrange the largest circular dimples on the central region of each spherical triangle and also on each apex of the spherical triangles of the spherical icosahedron, and arrange the annular dimples which have the same center as the largest circular dimples on each apex of the spherical triangles, outside of them. In accordance with the dimple arrangement of the present invention, the drag coefficient of a golf ball in a low-speed area has reduced and the carry distance has increased. In addition, the center of each annular dimple will act as an authentic axis of rotation when the annular dimple becomes at a right angle with the direction of air stream and so keep the ball's rotation longer, that secure the flying stability and a longer carry distance.

18 Claims, 5 Drawing Sheets

DW = Dia of Circular dimple
RD1 = Outside dia of Annular dimple
RD2 = Inside dia of Annular dimple
RW = Width between outside dia and inside dia of Annular dimple
LW = Width of Land area between inside dia of annular dimple and dia of circular dimple
CH = Depth of Circular dimple
RH = Depth of Annular dimple

GOLF BALL HAVING ANNULAR DIMPLES

FIELD OF THE INVENTION

This invention relates to the dimple arrangement of a golf ball which allows to extend its flying distance while maintaining flying stability, particularly in a low-speed area to provide a longer flight distance than a golf ball which has the conventional circular dimple arrangement.

BACKGROUND OF THE INVENTION

It was a long time ago to use a golf ball with circular dimples on its outer surface which is divided into the faces of an spherical polyhedron. The golf ball with dimples on its outer surface has a merit of long distance flight by providing symmetrical balance on the ball between right and left side and distributing air resistance evenly all over the ball surface. The compositions in dividing the sphere's surface of golf ball that are widely used at present include spherical icosahedron, spherical icosidodecahedron, spherical octahedron, spherical hexaoctahedron, spherical dodecahedron, or further divide into the faces of smaller polyhedron and the like. But, in reality, the compositions in dividing sphere's surface of aforementioned can be superimposed one another in a same sized sphere, therefore all of them may be considered as a same divisional composition in a broad sense. If circular dimples are arranged on the basis of above mentioned composition, the flying characteristic of a ball varies with both the area ratio and the volume ratio of dimples occupying the ball surface. However, it has been found that the balls which are manufactured with same materials, composite and a same production method, those balls with a difference of less than approximately 5% in the area ratio or volume ratio of dimples on the ball's surface achieved similar flying characteristic and similar carry distance although the dimples are arranged by several different compositions in dividing sphere's surface.

Hereupon, this inventor have closely examined flying characteristics of different golf balls, and eventually invented a ball that secures flying stability and longer carry distance based on the following mechanism. A golfer hits a golf ball, strong repulsive elasticity is generated on the ball by the power applied from the head of a golf club, at the same time back spin is generated by the loft angle of a golf club. If the club is driver, the impacted ball as explained above will fly away at an initial velocity of approx. 190~300 Km/Hr. and also be given back spin of approx. 2200~4500 R.P.M. at an initial state. At this moment, The dimples accelerates the transition of turbulent flow around the boundary layer of a rotating ball in flight through the high speed air stream, fluid(air) particles around the boundary layer get mixed and tangled mutually at the front part of the ball and it becomes difficult to be separated since energe is provided from outside of the layer, and consequently separation point moves backward and the width of separation region gets narrow, that the coefficient of drag is reduced. In the meantime, air pressure will increase beneath the ball rotating reversely whereas it decrease above the ball, as a result, aerodynamic lift equivalent to about 4~5 times of gravity is generated due to the Bernoulli effect, and it results to extend the carry distance of a ball. Additionally, it lowers a coefficient of drag even at a low-speed area by reducing the Critical Reynold's number.

However, it is difficult to extend a carry distance of a golf ball with the aforementioned conventional dimple arrangement using only circular dimples since the speed and rotation strength of the ball does not remain as initial state of hitting, they rapidly reduce from the peak of a ballistic trajectory to the landing point, accordingly the critical Reynold's number will rapidly increase and a coefficient of drag as well. Simply changing the compositions of dimple arrangement in dividing sphere's surface of a golf ball with different kind of spherical polyhedron, that resulted in the same situation.

In general, increasing the diameter of a circular dimple lowers a coefficient of drag in a low-speed area, whereas it raises the coefficient of drag in a high-speed area, on the contrary, decreasing the diameter of a circular dimple lowers a coefficient of drag in a high-speed area, but it tends to raise the coefficient of drag in a low-speed area. In consequence, proper combination of small diameter and large diameter dimples has been tried on the surface of a golf ball recently, however this also confronted with limitation.

To extend the carry distance of a golf ball, it is necessary to have excellent dimple arrangement that allows to minimize air resistance at both high-speed and low-speed areas, but there was no way to achieve everything in reality.

Meanwhile, in case of volume ratio of dimples on the surface of a golf ball having circular dimples only, has correlation with the area ratio of dimples on it's surface due to the definite size of a ball, it is impossible to make cavities for cover mold allowing to freely change the volume of dimples by ignoring the diameter of dimples and volume ratio to obtain fundamental lift. In other words, if the area ratio of dimples corresponds to about 75~84% of the total surface area of a golf ball having circular dimples only, the total volume of dimples on its surface will be around 350~500 $mm^3$. A volume ratio for obtaining fundamental aerodynamic lift becomes proportional to the diameter of dimples, that is, to increase the diameter of dimples results in a large volume of dimples and to decrease the diameter of dimples results in a small volume of dimples. Drag of any substance is a combination of pressure drag and friction drag. The strength of pressure drag is affected by the shape of the substance and the stream direction against it, whereas the strength of friction drag varies with the shearing strength caused by the viscosity of fluid flowing the surface of the substance and the roughness of the surface of the substance. Also a coefficient of drag varies with the Reynold's number.

Therefore, there is no problem in terms of a carry distance at a high-speed area from the hitting point to the peak of a ballistic trajectory, because a coefficient of drag diminishes as the Reynold's number grows in that area. The problem raises in a low-speed area from the peak of the ballistic trajectory to the landing point. Therefore, to extend the carry distance of a golf ball, it is desirable to decrease a coefficient of drag, particularly in a low-speed area. However, simply increasing the size of dimples cannot extend the carry distance because it increases volume ratio of dimples, and in turn a coefficient of drag in a high-speed area will increase. As an increase in a coefficient of pressure drag in a high-speed area is caused by high volume ratio of large dimples, that could not diminish a total drag.

TECHNICAL ASSIGNMENT TO BE ACHIEVED IN THIS INVENTION

This inventor has been able to solve several problems pointed out above by arranging the annular dimples which have the same center as the circular dimples to the outside of them, as a way to reduce a coefficient of pressure drag in a high-speed area, while diminishing drag in a low-speed area too.

This annular dimple acts as a large sized dimple when it faces with the air stream in a low-speed area, but it acts as a small sized dimple since its volume is smaller than a circular dimple's volume at a same diameter in a high-speed area. Also, when this annular dimple becomes at a right angle with air stream, it can act as an authentic axis of rotation and maintain the rotation of a ball longer, consequently a carry distance of the golf ball will be remarkably increased. Of course, just like a ball with conventional circular dimple arrangements, a ball made in accordance with this present invention can hold a basic symmetrical structure between right and left sides, and dimples are arranged by dividing the ball's surface into the faces of an spherical polyhedron which allows to maintain balance about the air resistance all over the ball surface.

BRIEF DESCRIPTION OF THE DRAWINGS

This invention will be explained in conjunction with an illustrative embodiment shown in the accompanying drawing, in which.

DETAILED DESCRIPTION OF THE PREFERRED EMBODIMENT

In the present invention, a golf ball's spherical outer surface is divided into the faces of an icosahedron consisting of 20 regular spherical triangles, and it's outer surface is further divided by great circle paths which obtained by extending spherical straight lines connecting the midpoint of each side of the sperical triangles of Icosahedron to its opposite apex, then large spherical pentagons are created on it's surface, and then, the center of large pentagon as a pole, which is a common apex of 5 regular spherical triangles of the spherical icosahedron, from the pole, spherical straight lines extend along the both sides of each of the 5 spherical triangles to the equator. (Same thing happens on the opposite pole.). The spherical outer surface is further divided by the spherical straight lines into small sections to arrange the dimples.

Regarding to the dimples, arrange the largest circular dimples on the central region of each spherical triangle and also on each apex of the spherical triangles of the spherical icosahedron, and arrange the annular dimples which have the same center as the largest circular dimples on each apex of the spherical triangles to the outside of them. With this way of dimple arrangement, the drag coefficient of a golf ball in a low-speed area has reduced and carry distance has increased. In addition, the center of each annular dimple will act as an authentic axis of rotation when the annular dimple becomes at a right angle with the direction of air stream and so keep the ball's rotation longer. In consequence, the golf ball in accordance with the present invention will secure the flying stability and a longer carry distance.

Figure 1:
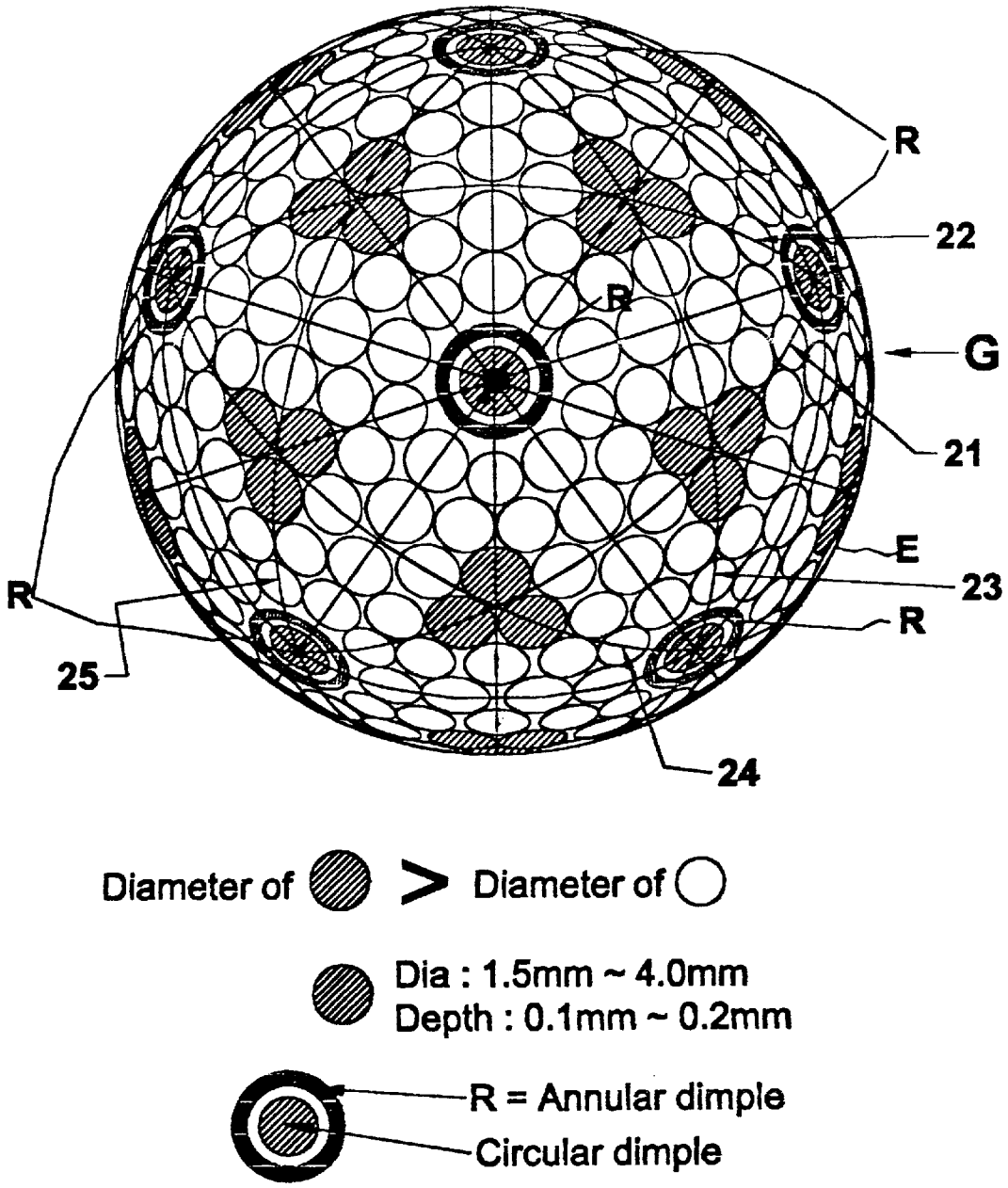
FIG.1 is a polar view of the surface of golf ball according to the present invention, a golf ball's spherical outer surface Is divided into the faces of an icosahedron consisting of 20 regular spherical triangles, and its outer surface is further divided by great circle paths which obtained by extending spherical straight lines connecting the midpoint of each side of the sperical triangles of icosahedron to its opposite apex, then large spherical pentagons will be created. Then, arrange the annular dimples which have the same center as the largest circular dimples on each apex of the spherical triangles forming the spherical icosahedron to be outside circular dimples. The dimples indicated in black color are the largest dimples among several kind of dimples on the ball's outer surface. They are arranged both on each apex of the spherical triangles and the central region of each spherical triangle to be well balanced in dividing sphere's surface as explained above.
Figure 2:
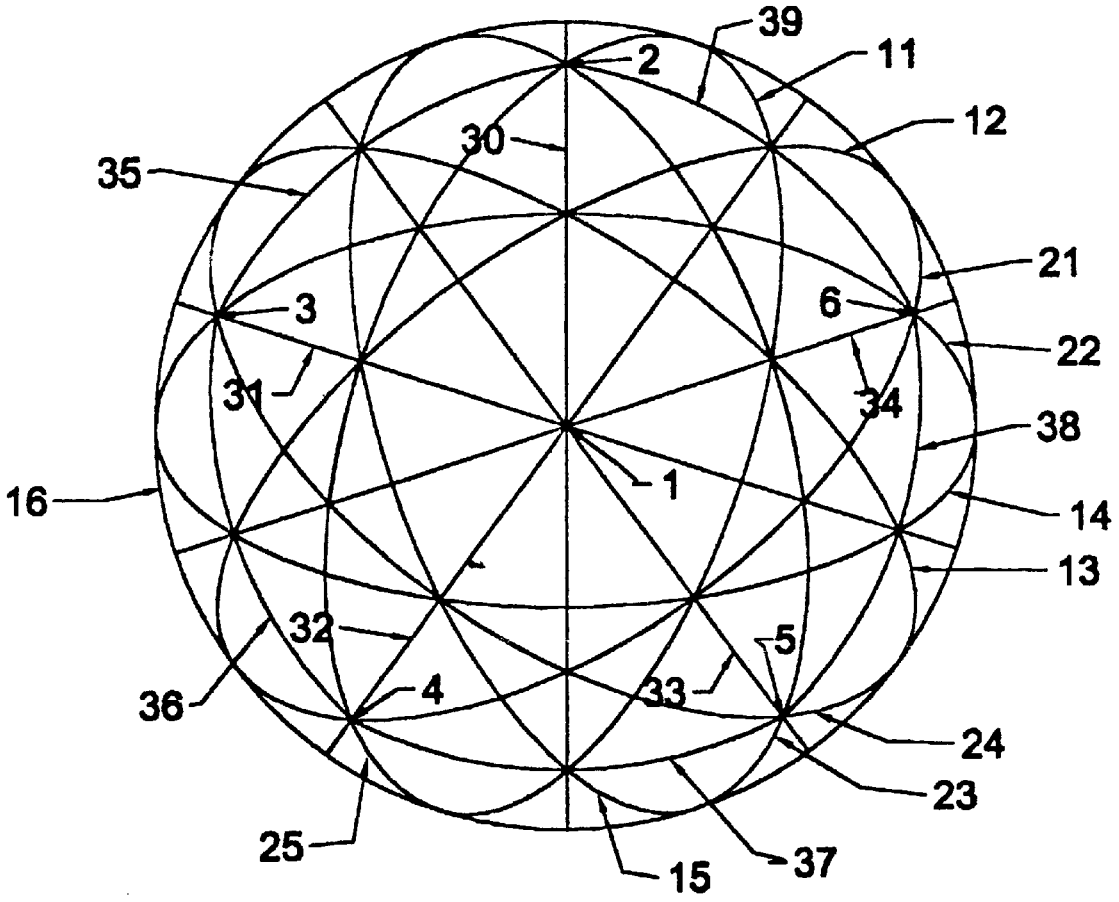
FIG.2 is a polar view of the ball that shows dividing sphere's surface for arranging dimples as illustrated In FIG.1.

With reference to FIG.2, the surface of a sphere is divided by lines(30,34,39), lines(30,31,35), lines(33,34,38), lines (31,32,36), lines(32,33,37) and so on into an spherical icosahedron consisting of 20 large spherical triangles. And, connect one of apices(2) of a large spherical triangle formed by lines (30,34,39) to the midpoint of its opposite line(34), then the new line is straightly connected with a line which is created by connecting the midpoint of line(34) to its opposite apex(5) of a large spherical triangle formed by lines (33,34,38) which, sharing a line(34) with a side of large spherical triangle formed by lines(30,34,39) in a same way, and such a way of continuous connection will make a new great circle paths(23). And, connect one of apices(6) of a large spherical triangle formed by lines (30,34,39) to the midpoint of its opposite line(30) and extend the another new line to the apex(3) of a large spherical triangle formed by lines(30,31,35) which sharing a line(30) with a side of large spherical triangle formed by lines (30,34,39), then a new great circle paths(22) will be created by this way of connection. Again, connect one of apices(2) of a large spherical triangle formed by lines(30,31,35) to the midpoint of its opposite line(31) and extend the line to the apex(4) of a large spherical triangle formed by lines(31,32,36) which sharing a line(31) with a side of large spherical triangle formed by lines (30,31,35). Similarly, this will create a new line(25). In consequence, the the surface of a sphere is further divided by the lines(21,22,23,24,25) which have been created in a way explained above, and these lines will make large spherical pentagons. And, the center of large pentagon(1) as a pole, which is a common apex of 5 regular spherical triangles of the spherical icosahedron, from the pole, spherical straight lines extend along the both sides of each of the 5 spherical triangles to the equator. (Same thing happens on the opposite pole.). The spherical outer surface is further divided by these spherical straight lines. And, the lines (11,12,13,14,15,16) will obtained by connecting the adjacent midpoints of the sides of large spherical triangle each other in a face of spherical Icosidodecahedron, among the lines, take the line (16)only as an equator of the sphere. The arrangement of circular dimples, including annular dimples by the aforementioned composition in dividing the sphere's surface of golf ball is illustrated in FIG. 1. Another critical point of the present invention is to stabilize a drag of each region over the ball's surface, at a golf ball(G) which is made by the composition presented in FIG.1, the ball becomes well balanced by arranging the largest circular dimples both on the central region and apices of large spherical triangles, as shown by the dimples filled with dark slashes. On the other hand, annular dimples(R), the most key embodiment of the present invention, are arranged outside of those largest dimples which have the same center as the annular dimples, that is to enlarge the size enough to decrease whole drag in a low-speed area while reducing the pressure drag in a high-speed area, for the purpose of present invention. If the size of the annular dimple is too small, then this purpose cannot be accomplished. Also, when arranging too small sized circular dimple or none inside a certain sized annular dimple, then unnecessary land area (area with no dimples) becomes too wide, it is hard to gain enough aerodynamic lift. Arranging these annular dimples(R) is very important, as shown in FIG. 1, if annular dimple of which center is a pole(P) is arranged, it is desirable to place the rest of annular dimples with same size and same distance from the pole, in a way to keep a balance all over the surface of golf ball. If they are not balanced over the surface of ball or have different sizes, there are considerable differences in drag at each region of the surface of golf ball, in particular a coefficient of friction drag shows a big difference, that may cause an unstable flying characteristics and changes in flying direction.

Figure 3:
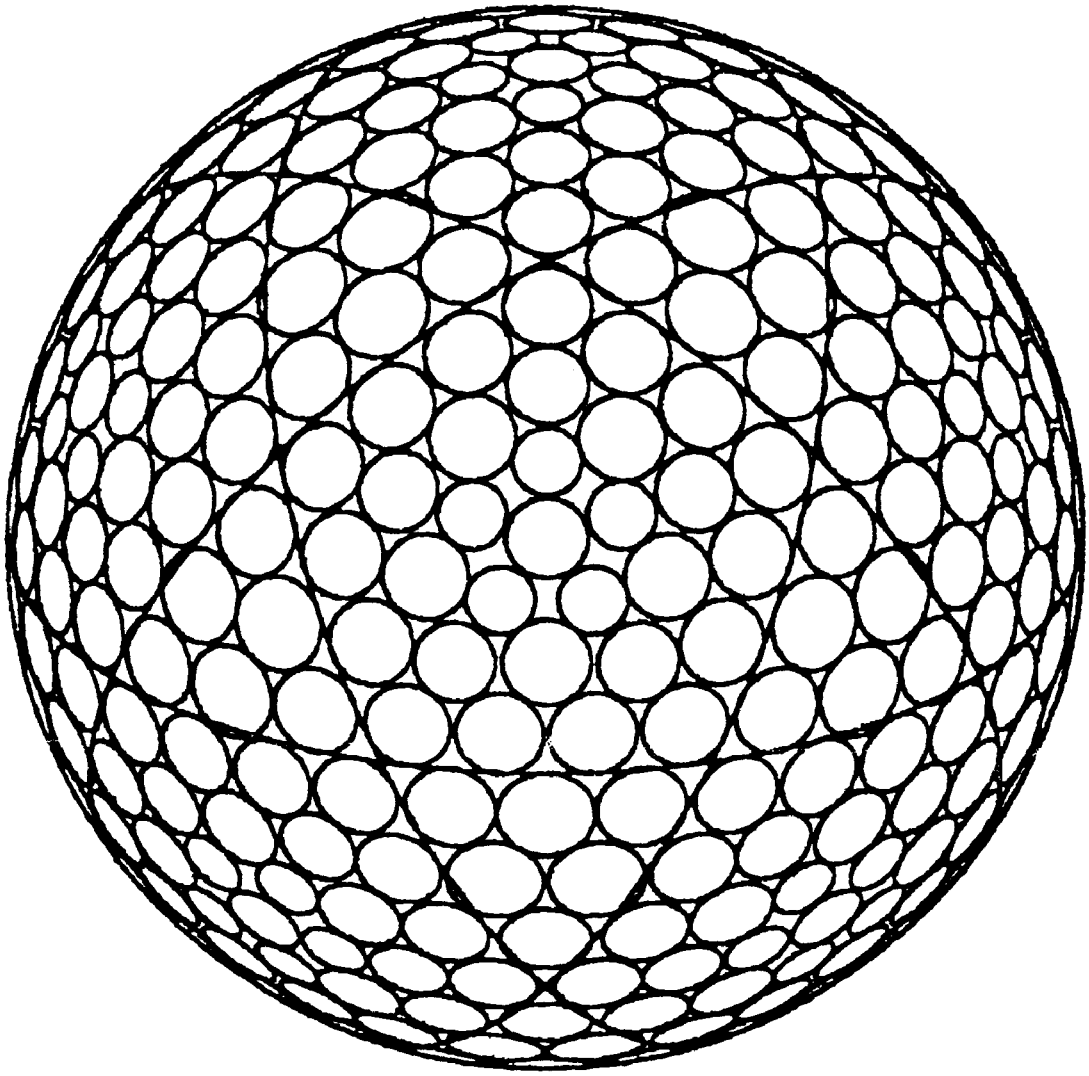
Prior Art FIG. 3
FIG.3 shows the conventional arrangement of circular dimples by dividing into the face of an icosidodecahedron in order to compare with a new arrangement of dimples containing both circular and annular dimples in accordance with the present invention.
Figure 4:
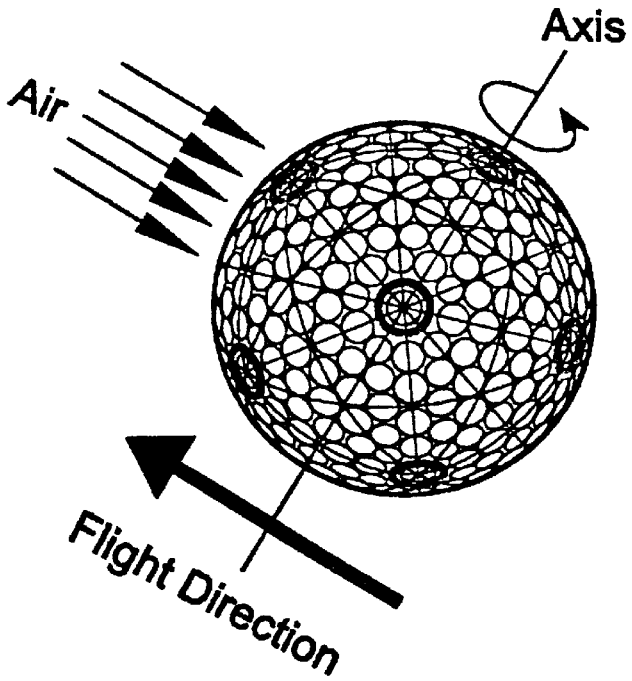
FIG.4 demonstrates a golf ball in flight with backspin according to the present invention, when this annular dimple becomes at a right angle with air stream, the center of annular dimple act as an authentic axis of rotation.
Figure 5:
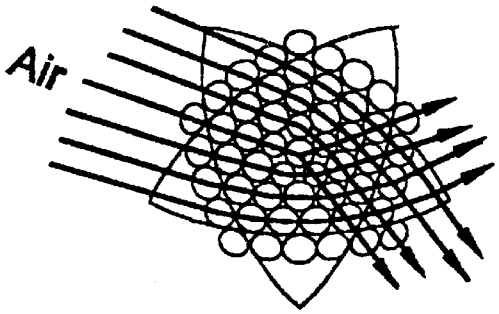
Prior Art FIG. 5
FIG.5 shows air streams around the dimples arranged on the face of spherical pentagon which is one of the polygon of spherical icosidodecahedron while a golf ball with conventional circular dimple arrangement on the composition of spherical icosidodecahedron flies in a low-speed.
Figure 6:
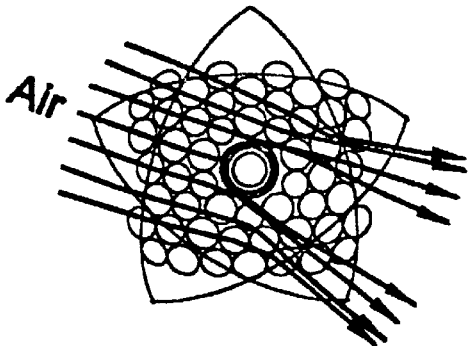
FIG.6 demonstrates air streams around the dimples arranged on the face of large spherical pentagon configuration, which are affected by annular dimples while the ball according to the present invention flies in a low-speed.

A rapid increasing of drag of golf ball with conventional circular dimples in a low-speed area is caused by the whirlpool which is shifted from the back at the separation region to the front, owing to the more reduced speed air stream than as in a high-speed area, at this time, the dimple pattern substantially affects the air stream. In a golf ball with conventional circular dimples only as shown in FIG. 3, air stream in a low-speed area will cross each other and be tangled around the spherical pentagon of spherical icosidodecahedron by the reason of dimple arrangement pattern, in consequence the whirlpool can easily generated, that illustrated in FIG. 5. On the contrary, annular dimple around the central region of large spheriacl pentagon on the surface of the golf ball in accordance with the present invention do not disturb air stream, and push the whirlpool to the backward by separating the air stream into the two sides, that illustrated in FIG. 6. As revealed by comparison between FIG. 5 and FIG. 6, the golf ball according to the present invention can lower the drag in a low-speed area by reducing relatively the Critical Reynold's number. When the annular dimple becomes at a right angle with the direction of air stream in a low-speed area and in a high-speed area, the center of annular dimple will act as an authentic axis of rotation, therefore the ball's rotation longer as shown in FIG. 4, as a result, contributes to extend a carry distance of the golf ball. This is because of a revolution of air as a circle in the groove of annular dimples and near the annular dimples in such a condition.

Figure 7:
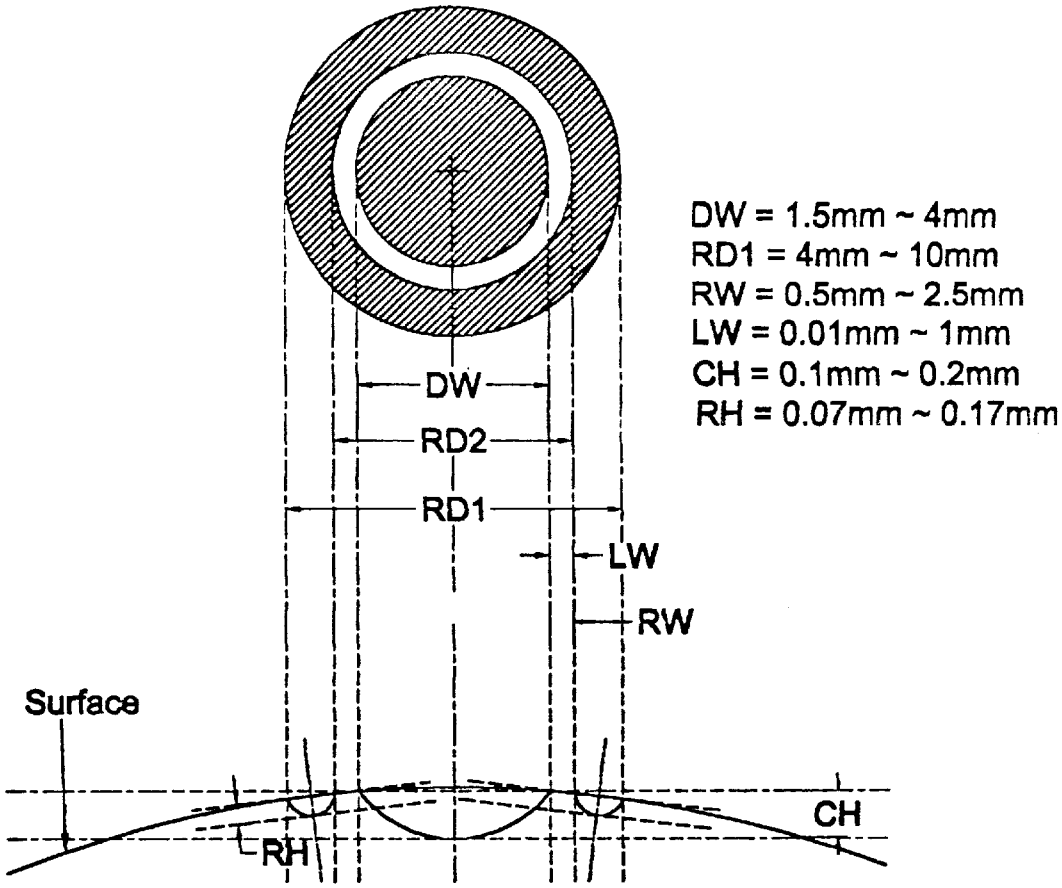
FIG.7 illustrates the method of determining size and depth of a circular dimple and an annular dimple, both of which share the same center.

Meanwhile, the size, depth, width, and shape of the annular dimples are very importance to the present invention in relation to the size, depth, width, and shape of the circular dimples which have the same center as the annular dimples. In the measurement method as illustrated in FIG. 7, if an outer diameter of annular dimple(RD1) is 10 mm or more, the ball can be easily affected by a side wind when it flies in a low-speed area, and its flying stability becomes easily deteriorated, and if an outer diameter of annular dimple (RD1) is 4 mm or less, the annular dimple cannot serve as enough as aimed in the present invention. The width of groove of this annular dimple (RW) is correlated with the inner diameter of annular dimple(RD2) and proper size will be 0.5~2.5 mm. If it is less than 0.5 mm, the purpose of the present invention cannot be achieved, on the other hand, if it is more than 2.5 mm, the dimple may raise a coefficient of friction drag in a low-speed area and shortens the carry distance.

Regarding a circular dimple arranged to the inside of an annular dimple, the circular dimple is the biggest one among the circular dimples used in the present invention. When its size is less than a certain value, an annular dimple also becomes smaller because both have same center, and the annular dimple cannot serve the aim of the present invention. If enlarging the size of annular dimple and diminishing only the size of circular dimple, unnecessary land region of the golf ball gets larger and overall area ratio of dimples is too low to obtain required aerodynamic lift. The proper diameter of the circular dimple(DW) in the inside of an annular dimple is 1.5~4 mm. If it is less than 1.5 mm, the annular dimple cannot efficiently reduce the Critical Reynold's number in a low-speed area, as the result, it is difficult to reduce the drag coefficient of the ball. On the contrary, if the diameter of circular dimple is more than 4 mm, the same-centered annular dimple gets too big, thus the flying stability of the ball grow worse under the influence of the side wind in a low-speed area, and an increasing of a coefficient of pressure drag in a high-speed area, consequently the carry distance of it becomes shortened.

The proper land area(LW) between an annular dimple and a same-centered circular dimple is a very important factor, the adequate size is 0.01~1 mm. If this area is less than 0.01 mm, it is hard to make a cavity for mold which meets the purpose of the present invention, and if the area is more than 1 mm, it makes an unnecessary land area, accordingly it is difficult to obtain the aerodynamic lift, as the result, the ball cannot increased the carry distance and an air stream is also badly affected.

Regarding to the depth of annular dimples and the same-centered circular dimples should be determined in conjunction with a volume ratio of all dimples over the ball's surface. Since both of dimples have a same center, the deepest length(CH) in a straight line by connecting the edge to edge of the circular dimple in FIG. 7 is taken as the depth of the circular dimple.

Likewise, the deepest length(RH) in a straight line by connecting the edge to edge of the groove of annular dimple is taken as the depth of the annular dimple. 0.1~0.2 mm is suitable for the depth(CH) of a circular dimple, if the depth is shallower than 0.1 mm, it is difficult to obtain a necessary aerodynamic lift, and if the depth of the circular dimple is deeper than 0.2 mm the carry distance will be decreased due to an increasing of a coefficient of drag in a high-speed area. For the depth(RH) of annular dimple, 0.07~0.17 mm is suitable, if the depth is shallower than 0.07 mm, the aim of the present invention cannot be achieved, and if deeper than 0.17 mm, the carry distance of the ball will be decreased due to a drag phenomenon(the ball is dragged in the opposite direction to the flying direction) which is caused by a partial vacuum of the inside of annular dimple in a high-speed area. And in a low-speed area, a coefficient of friction drag increases and the flying stability will be lower and also the carry distance of the ball will be decreased.

Effect of the Invention

By divisioning a golf ball's surface into a well-balanced spherical polyhedrons as explained above, arranging the annular dimples at regular intervals and placing a same-centered circular dimple to the inside of each annular dimple between the circular dimples, thereby improving the golf ball's carry distance while maintaining its aerodynamic stability in a low-speed area by lowering the Critical Reynold's number relatively and a coefficient of drag as compared with the arrangement of circular dimples only on the surface of the common golf ball.

What is claimed is:

1. A golf ball (G) having a spherical surface with (A) a plurality of annular dimples (R) arranged in each apex of the 20 large spherical triangles of a spherical icosahedron theoretically formed by dividing the spherical surface of the golf ball into the faces of an spherical icosahedron consisting of 20 large spherical triangles, (i) said spherical surface being theoretically divided by great circle paths formed by extending spherical straight lines (21–25) connecting the midpoint of each side (30–39) of said large spherical triangles of said spherical icosahedron to its opposite apex (1–6) to create twelve large spherical pentagons, a pole (1) of each said large spherical pentagon being a common apex of five regular spherical triangles of the spherical icosahedron, (ii) said spherical surface being theoretically divided by spherical straight lines extending from the pole (1) along both sides (30–34) of each of the five regular spherical triangles to an equator (16), and (iii) said spherical surface being theoretically divided by spherical straight lines (11–15) into small sections; and (B) a plurality of variously sized solid circular dimples arranged in said spherical surface of the golf ball; said various sized solid circular dimples being centered on said small sections with:

(i) the largest sized solid circular dimples among said various sized solid circular dimples in the central region of each of said large spherical triangles and at the apices thereof, (ii) one of said annular dimples (R) being centered at each apex of said large spherical triangles, so that each one of said the largest sized circular solid dimples has the same center as the annular dimple (R) on each apex of said large spherical triangles, and (iii) the smaller sized solid circular dimples among said variously sized solid circular dimples being located in the rest of said small sections.

2. The golf ball of claim 1, wherein the outside diameter of said annular dimple is 4 mm~10 mm and the width between the outside diameter and the inside diameter of said annular dimple is 0.5 mm~2.5 mm.

3. The golf ball of claim 2, wherein the depth of annular dimple is 0.07 mm~0.17 mm.

4. The golf ball of claim 1, wherein the diameter of circular dimple which has the same center as the annular dimple is 1.5 mm~4 mm.

5. The golf ball of claim 4, wherein the depth of circular dimple is 0.1 mm~0.2 mm.

6. The golf ball of claim 1, wherein the width of land area between the annular dimple and the same-centered circular dimple is 0.01 mm~1 mm.

7. The golf ball of claim 1, wherein the circular dimples are arranged with various diameters on the said sphere's surface.

8. The golf ball of claim 1, wherein the circular dimples are arranged on the said sphere's surface are identical in diameter.

9. The golf ball of claim 8, wherein the circular dimples are arranged with various depths on the said sphere's surface.

10. The golf ball of claim 8, wherein the circular dimples arranged on the said sphere's surface are identical in depth.

11. The golf ball of claim 1, wherein the circular dimples are arranged with various depths on the said sphere's surface.

12. The golf ball of claim 1, wherein the circular dimples arranged on the said sphere's surface are identical in depth.

13. The golf ball of claim 1, wherein the annular dimples arranged with various diameters on the said sphere's surface.

14. The golf ball of claim 13, wherein the annular dimples are arranged with various depths on the said sphere's surface.

15. The golf ball of claim 13, wherein the annular dimples arranged on the said sphere's surface are identical in depth.

16. The golf ball of claim 1, wherein the annular dimples arranged on the said sphere's surface are identical in diameter.

17. The golf ball of claim 16, wherein the annular dimples arranged with various depths on the said sphere's surface.

18. The golf ball of claim 16, wherein the annular dimples arranged on the said sphere's surface are identical in depth.

* * * * *